US012644599B2

(12) United States Patent
Paubel et al.

(10) Patent No.: US 12,644,599 B2
(45) Date of Patent: Jun. 2, 2026

(54) MONITORING COMBUSTIBLE MATTER IN A GASEOUS STREAM

(71) Applicant: L'Air Liquide, Société Anonyme pour l'Etude et l'Exploitation des Procédés Georges Claude, Paris (FR)

(72) Inventors: Xavier Paubel, Montigny le Bretonneux (FR); Abou Ba, Les Loges-en-Josas (FR); Frank Rheker, Düsseldorf (DE); Laurent Kepinski, Cracow (PL); Mohand Amirat, Gas (FR); Jean-Baptiste Senechal, Franconville (FR); Sarah Juma, Versailles (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 361 days.

(21) Appl. No.: 18/273,595

(22) PCT Filed: Jan. 21, 2022

(86) PCT No.: PCT/EP2022/051338
§ 371 (c)(1),
(2) Date: Jul. 21, 2023

(87) PCT Pub. No.: WO2022/157304
PCT Pub. Date: Jul. 28, 2022

(65) Prior Publication Data

US 2024/0125470 A1 Apr. 18, 2024

(30) Foreign Application Priority Data

Jan. 22, 2021 (EP) ..... 21152977

(51) Int. Cl.
*F23G 7/08* (2006.01)
*F23L 7/00* (2006.01)
*F23N 5/08* (2006.01)

(52) U.S. Cl.
CPC ..... *F23G 7/085* (2013.01); *F23L 7/007* (2013.01); *F23N 5/082* (2013.01);
(Continued)

(58) Field of Classification Search
CPC ..... F23G 7/085; F23G 2207/104; F23G 2207/30; F23G 2209/14; F23L 7/007; F23L 2900/07005; F23N 5/082
(Continued)

(56) References Cited

U.S. PATENT DOCUMENTS 4,101,632 A * 7/1978 Lamberti ..... F23G 7/065 431/5
5,055,032 A * 10/1991 Altemark ..... F23D 14/20 60/753
(Continued)

FOREIGN PATENT DOCUMENTS

DE 10 2014 013 474 3/2016
EP 0 553 632 8/1993
(Continued)

OTHER PUBLICATIONS

International Search Report and Written Opinion for corresponding PCT/EP2022/051338, Apr. 22, 2022.

*Primary Examiner* — Avinash A Savani
(74) *Attorney, Agent, or Firm* — Elwood L. Haynes

(57) ABSTRACT

A method and device for monitoring combustible matter in a hot gaseous stream and generating a control signal, a controlled jet of an oxidant is injected into the gaseous stream with a lance extending between a window of a monitoring device and the flow path of the gaseous stream,
(Continued)

the lance defining a line of sight between the window and the gaseous stream in the flow path, the combustible matter burns with the oxidant in a flame in the gaseous stream in front of the lance, one or more properties of the flame which are correlated with the concentration of combustible matter in the gaseous stream are detected by the monitoring device through the line of sight and the window and the monitoring device processes the one or more detected flame properties and generates a control signal on the basis of the one or more detected flame properties.

8 Claims, 2 Drawing Sheets

(52) U.S. Cl.
CPC .... *F23G 2207/104* (2013.01); *F23G 2207/30* (2013.01); *F23G 2209/14* (2013.01); *F23L 2900/07005* (2013.01)

(58) Field of Classification Search
USPC ..... 431/2
See application file for complete search history.

(56) References Cited

U.S. PATENT DOCUMENTS

| | | | | |
|---|---|---|---|---|
| 5,520,123 | A | 5/1996 | Chappell et al. | |
| 8,048,381 | B2 | 11/2011 | Hunsinger et al. | |
| 2011/0154949 | A1 | 6/2011 | Rheker | |
| 2013/0115560 | A1 | 5/2013 | Beaudoin et al. | |
| 2016/0076765 | A1 | 3/2016 | Goldbach | |
| 2017/0370579 | A1* | 12/2017 | Johnson | G05B 19/418 |
| 2018/0209853 | A1* | 7/2018 | Kraus | G01N 21/72 |
| 2020/0386404 | A1* | 12/2020 | Kraus | G06V 10/25 |

FOREIGN PATENT DOCUMENTS

| | | |
|---|---|---|
| EP | 2 703 716 | 3/2014 |
| EP | 2 843 340 | 3/2015 |
| ES | 2 207 389 | 5/2004 |
| WO | WO 2010 022964 | 3/2010 |

* cited by examiner

[Fig. 1]
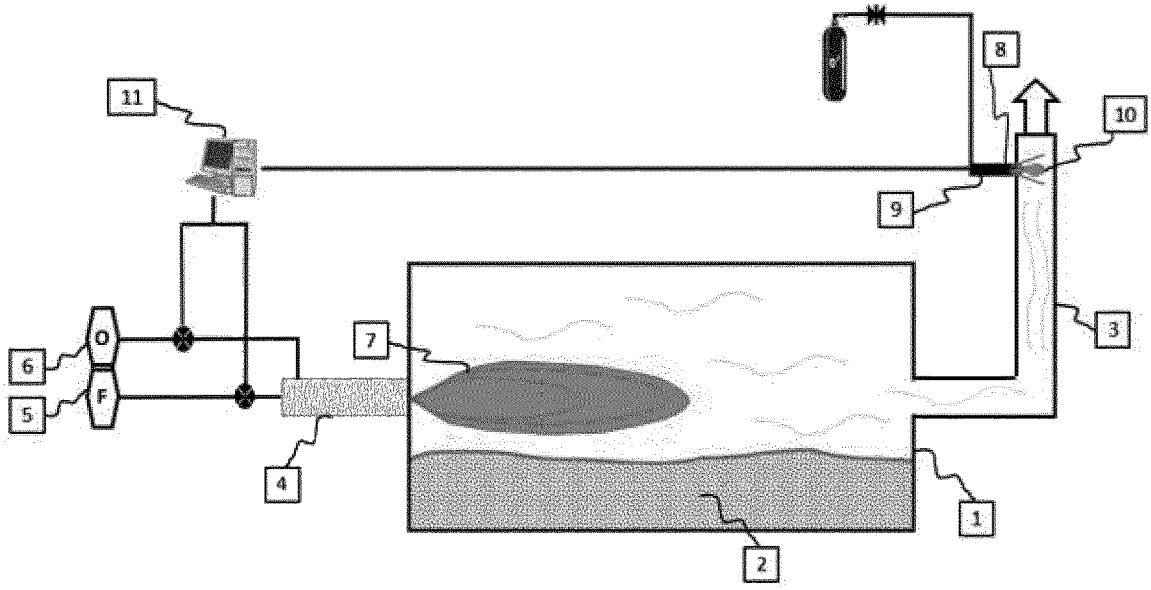
[Fig. 2]
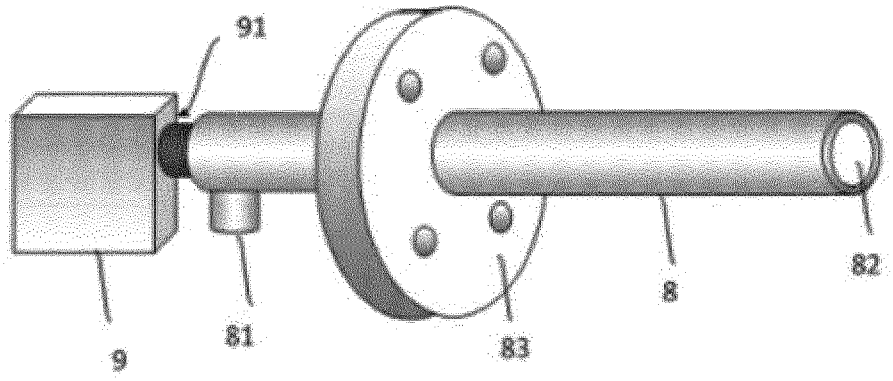
[Fig. 3]
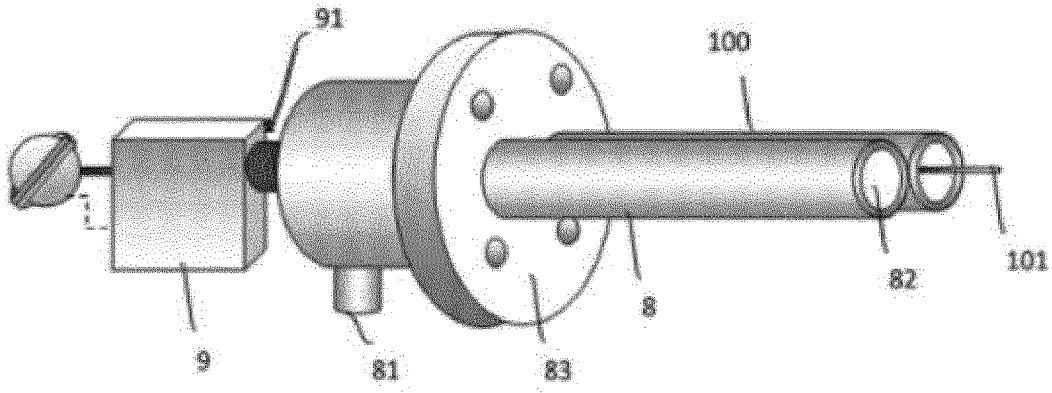

[Fig. 4]
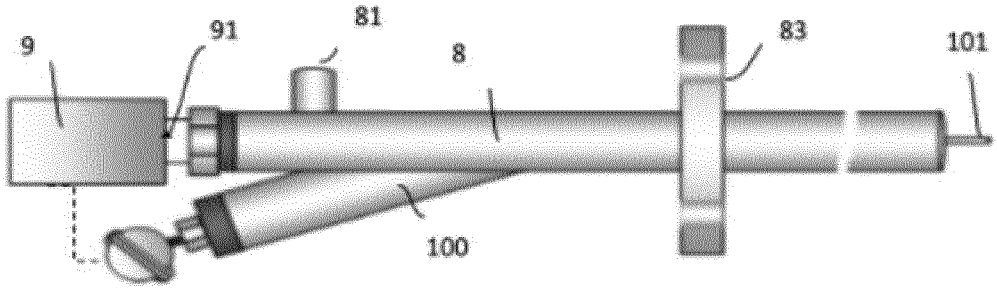

MONITORING COMBUSTIBLE MATTER IN A GASEOUS STREAM

CROSS REFERENCE TO RELATED APPLICATIONS

This application is a 371 of International Application No. PCT/EP2022/051338, filed Jan. 21, 2022, which claims priority to European Patent Application No. 21152977.1, filed Jan. 22, 2021, the entire contents of which are incorporated herein by reference.

BACKGROUND

The present invention relates to a method for monitoring combustible matter present in a gaseous stream.

It is known in the art to monitor a flame inside a combustion furnace and to use the monitoring results to control the combustion process in the furnace.

EP-A-2843340 proposed a method for detecting a combustion gas in the atmosphere of a furnace heated by means of a burner and an oxygen feed. According to said known method, oxygen is injected into the combustion furnace at high speed so as to generate turbulence (circulation) in the furnace atmosphere. The combustion gas to be detected is ignited with the presence of said oxygen and the spectrum of the resulting flame is used to detect the presence of said combustion gas in the furnace atmosphere. In practice, this known method presents a number of disadvantages. In most industrial combustion furnaces, the volume occupied by the combustion space and the normally generated flow patterns in the combustion atmosphere are such that an excessive amount of oxygen or an excessive oxygen injection velocity, typically both, would be required in order to generate sufficient turbulence in the furnace atmosphere in order for the detection of the combustion gas to be reliable as opposed to dependent on temporary local accumulations of the combustion gas in the atmosphere. The injection of oxygen in the amount and/or with the velocity required for reliable detection would not only be costly, it would also significantly affect the actual purpose for which the combustion furnace is operated, in that, for example, it may cause undue oxidation of the charge, change the temperature profile in the furnace, etc. In addition, it is typically not possible to isolate the spectrum of the flame generated through the injection of said oxygen and the spectrum of the flame or flames generated by the main burner(s) of the combustion furnace, which again makes the detection of the combustion gas by means of the described method unreliable.

It is also known in the art to monitor the presence of a combustion gas in the flue gas of a combustion furnace. From ES-A-2207389, a method is known which does not present the disadvantages of the first-mentioned known method. According to ES-A-2207389, oxygen is injected into the flue gas of a combustion furnace for melting an aluminium load which may contain organic matter, to detect the temperature variation caused in the flue gas by said oxygen injection and to adjust the oxygen/fuel ratio of the burner in the furnace in function of the detected temperature variation. When, as disclosed in ES-A-2207389, the oxygen/fuel ratio of the burner in the furnace is adjusted in function of whether the detected temperature variation is a positive or a negative one, the method has limited precision, resulting in frequent changes of the oxygen/fuel ratio of the burner in the furnace and potentially unstable furnace operation. Using the value of the generated temperature variation provides some improvement, but remains inaccurate as it fails to take into account other factors which may affect the detected temperature variation, such as cyclical (burner power change for example) or non-cyclical changes (type of scrap) in the temperature at which the flue gas leaves the melting furnace.

There is therefore a need for a more reliable and more accurate method for detecting combustible substances in the combustion gases generated by a combustion process.

SUMMARY

The present invention aims to overcome, at least in part, the problems associated with the above-referenced prior art methods.

As being able to detect combustible matter in a gas is not only of interest for gases generated by combustion processes, the solution proposed by the present invention is also applicable to gases, other than combustion gases, which are available at temperatures similar to the temperatures of combustion furnace flue gases.

The present invention relates in particular to a method for monitoring combustible matter in a gaseous stream which flows at a temperature of at least 550° C. along a flow path extending from a gas inlet to a gas outlet. Said flow path thus does not include the installation or equipment, such as a combustion furnace, which produces the gaseous stream to be monitored.

The temperature of the gaseous stream flowing along the flow path is preferably at least 600° C., more preferably at least 700° C. Said temperature may reach up to 1500° C. or even up to 1800° C.

The combustible matter in the gaseous stream is monitored by means of a monitoring device, which comprises a window. A lance extends between the window of the monitoring device and the flow path of the gaseous stream and defines a line of sight between the window and the gaseous stream in the flow path.

According to the present invention, a controlled jet of an oxidant having an oxygen content of 22 to 100% vol is injected into the gaseous stream by means of the lance. In the presence of combustible matter in the gaseous stream, said combustible matter burns with the injected oxidant in a flame within the gaseous stream in front of the lance.

In the present context, a fluid jet is considered "controlled", when the jet flows at a controlled or determined flow rate and/or flow velocity.

According to the invention, one or more properties of the flame, which are correlated with the concentration of combustible matter in the gaseous stream, are detected by the monitoring device through the line of sight and the window, whereafter the monitoring device processes the one or more detected flame properties and generates a control signal on the basis of said one or more detected flame properties.

As the monitoring is performed in a flow path downstream of any equipment in which the gaseous stream is generated, said monitoring is possible without any risk of interference from the processes taking place in said equipment on the detection of the one or more flame properties.

The flow path is typically located in or defined by a gas duct.

The controlled jet of oxidant has multiple functions. In the first place, the controlled jet provides the oxygen, which, together with the combustible matter in the gaseous stream, generates a flame in the gaseous stream. Moreover, as the controlled jet provides said oxygen in a controlled manner, the flame is also generated in a controlled manner, thus providing a more reliable monitoring of any combustible matter present. In addition, the controlled jet of oxidant screens the monitoring device from the gaseous stream and thus protects the monitoring device from damage or soiling by the gaseous stream, its components and/or its temperature, thereby increasing the durability and reliability of the method.

Although the method according to the invention may be performed with any oxidant having an oxygen content of at least 22% by volume, such as, for example oxygen-enriched air, oxidants with higher oxygen contents are preferred for easier ignition of the combustible matter in the gaseous stream. The oxidant of the controlled jet may thus have an oxygen content of at least 30% vol, preferably of at least 60% vol and more preferably of at least 90% vol or at least 98% vol oxygen.

Similarly, although the method may be performed with the injection into the gaseous stream of oxidant at ambient or non-cryogenic sub-ambient temperatures, but typically above 0° C., injecting a controlled jet of oxidant at a higher temperature provides for easier ignition of the combustible matter in the gaseous flow. Thus, the oxidant used in the method according to the invention may be at ambient temperature or above, and may be preheated to a temperature of, for example, at least 100° C., at least 150° C., at least 200° C., etc. and in particular up to 600° C. or up to 650° C.

According to a preferred embodiment of the present invention, the controlled jet of oxidant is injected by means of the lance at a flow rate between 0.1 $Nm^3/h$ and 50.0 $Nm^3/h$ and more preferably between 0.2 and 25.0 $Nm^3/h$.

According to a useful embodiment, the lance is positioned such that the line sight forms an angle with the flow direction of the gaseous stream direction of between 5° to 175°, preferably between 25° to 155° and more preferably between 45° and 135°, whereby the angle is defined as the angle between the line of sight and the gaseous stream in the flow directions of the controlled jet and of the gaseous stream. Thus, when the angle is smaller than 90°, the oxidant jet is injected partially co-currently with the gaseous stream when the angle is greater than 90°; the controlled jet is injected partially counter-currently to the gaseous stream. When the angle is 90°, the controlled oxidant jet is injected perpendicularly to the flow of the gaseous stream along the flow path.

The extent to which the lance extends into the flow path can vary and is typically 0% (such as, when the downstream end of the lance flush with an outer wall of the flow path) to 50% of the cross-section diameter of the flow path.

It is known from EP-A-2701716 to heat off-gasses from a thermal process in that the off-gasses are made to flow through a combustion chamber in which heat is generated by combusting fuel with an oxidant containing at least 25% vol oxygen. The off-gasses may thereby be heated to a temperature from 200 to 1700° C., in particular 400 to 800° C. According to one embodiment, combustible matter in the of-gasses is used as fuel and is combusted in the combustion chamber with said oxidant without addition of further fuel. The combustion chamber may be a widening of the off-gas evacuation canal provided with a refractory wall. For the injection of fuel and oxidant, or of oxidant only, into the combustion chamber, burner lances may be used, through which fuel and oxidant may be provided in a coaxial manner. Said burner lances may be equipped with ignition systems and may be monitored by means of infrared or ultraviolet probes. Monitoring of any combustible matter present in the off-gases is neither disclosed nor suggested in EP-A-2701716.

The control parameter which, according to the present invention, is generated by the monitoring device on the basis of the one or more detected flame properties and may be used in various ways or in a combination of ways. For example, the control parameter may be communicated to a user interface so as to allow an operator to verify or record the combustible-matter content of the gaseous stream.

The control parameter may also be compared with a predetermined reference value or a predetermined reference range in a processing unit, which may or may not be integrated in the monitoring device, and an alarm signal may be generated if the generated control parameter is higher or lower than the reference value (depending on the nature of the control parameter and whether the reference value is a predetermined maximum value or a predetermined minimum value) or if the generated control parameter falls outside the predetermined range.

The control parameter may also be communicated to an upstream installation and/or to a downstream installation in which the generated control parameter is effectively used as a control parameter for the control of said installation and/or of the process taking place therein. An upstream installation is understood to be an installation located upstream of the gas inlet of the flow path in the flow direction of the gaseous stream. An example of such an upstream installation is the installation generating the gaseous stream, such as a combustion installation generating a gaseous stream of hot combustion gases. A downstream installation is understood to be located downstream of the gas outlet of the flow path in the flow direction of the gaseous stream. An example of a downstream installation may be a downstream gas treatment installation for the treatment of the gaseous stream, for example, but not limited to installations for cleaning or purifying the gaseous stream. The downstream installation may also be an installation for the valorisation of the gaseous stream, for example by chemical conversion thereof.

The one or more flame properties detected by the monitoring device may include a radiation intensity of the flame generated in the gaseous stream following the injection of the controlled jet of oxidant therein. The monitoring device may thus detect a radiation intensity of said flame in the visible and/or non-visible range, preferably in the visible or infrared spectrum range, preferably a combination of both, for example in the wavelength range of 400 to 1000 nm.

The monitoring device may also comprise a temperature sensor in contact with the gaseous stream, such as a thermocouple, for measuring a temperature in the gaseous stream, in addition to the one or more properties of the flame which are detected by the monitoring device through the line of sight and the window. According to a preferred embodiment, said temperature sensor is positioned in a controlled jet of an oxidant having an oxygen content of 22 to 100% vol, which controlled jet is injected into the gaseous stream, the temperature sensor then measuring a temperature of a flame generated in said gaseous stream by combustion of combustible matter in the gaseous stream with the oxidant of this controlled jet, when the gaseous stream contains such combustible matter.

According to one such embodiment, the temperature sensor is located in the lance defining the line of sight. In that case, the controlled jet of oxidant in which the temperature sensor is located is identical to the controlled jet injected by means of said lance and the temperature sensor measures a temperature of the flame of which one or more properties are detected by the monitoring device through the line of sight and the window.

According to an alternative embodiment, the controlled jet of oxidant in which the temperature sensor is located is a second controlled jet which differs from the controlled jet of oxidant injected by means of the lance (corresponding to a first controlled jet). In that case, the monitoring device also comprises a separate injector for injecting into the gaseous stream the further (second) controlled jet of oxidant in which the temperature sensor is located. The first and second controlled jets may be injected into the gaseous stream at adjacent locations or at spaced-apart locations.

The monitoring device may use the temperature measured by the temperature sensor (a) as an additional input for generating the control signal, i.e. the monitoring device generates the control signal on the basis of both the one or more flame properties detected by the monitoring device through the line of sight and the window as well as the temperature measured by the temperature sensor; (b) as a verification input, whereby the monitoring device generates an alert signal when the temperature measured by the temperature sensor indicates a significantly different level of combustible matter in the gaseous stream compared to the level of combustible matter in the gaseous stream corresponding to the value(s) of the one or more flame properties detected by the monitoring device through the line of sight and the window or (c) as a backup input, whereby the monitoring device generates the control signal on the basis of the temperature measured by the temperature sensor when the monitoring device cannot generate said control signal on the basis of the one or more flame properties detected by the monitoring device through the line of sight and the window, for example according to the process described in WO-A-2010/022964.

According to one embodiment, the monitoring device detects and/or processes the one or more flame properties intermittently, for example in order to reduce the energy consumption of the monitoring device. According to a preferred embodiment, the monitoring device detects and processes the one or more flame properties continuously.

The one or more flame properties detected by the monitoring device and/or the control signal generated by the monitoring device on the basis of same are usefully stored in a data storage device. The thus stored data may later be retrieved and, for example, be used for the evaluation of the performance of the upstream installation generating the gaseous stream, in the a posteriori evaluation of an incident or for optimizing future process control, in particular by means of an automated learning process.

The one or more detected flame properties and/or the generated control signal may usefully be communicated to one or more user interfaces and be displayed thereon/thereby. The user interface may be part of a mobile device, such as a mobile phone, tablet, etc. The user interface may also be located in a local or remote control station.

The method according to the present invention may be used for monitoring combustible matter in a wide range of gaseous streams, provided the gaseous stream has a temperature of at least 550° C., as mentioned above. The method according to the present invention is notably useful for monitoring combustible matter in a combustion flue gas stream from a combustion installation.

In combustion installations, thermal energy is generated by combustion. The presence of combustible matter in the flue gas of a combustion installation is an indication of incomplete combustion in the installation, i.e. below optimum furnace operation as far as energy generation in the furnace is concerned. Such below optimum furnace operation may, for example be due to variations in the composition of a combustible furnace charge (such as in waste incineration kilns or shaft furnaces) or by the presence of combustible substances in a charge to be melted, such as scrap metal, which are released in an uncontrolled manner during the melting process. According to the present invention, the presence of combustible matter in the flue gas of such a combustion installation can be reliably monitored. In certain cases, incomplete combustion in the furnace is purposefully sought, in particular in order to provide a chemically reducing atmosphere inside the furnace. In such cases, the flue gas of the combustion installation de facto contains combustible matter and the method and device according to the invention may advantageously be used to monitor the concentration or level of combustible matter in the flue gas and variations of said concentration or level, for example due to the presence of combustible substances in the charge, such as scrap metal, which are released in an uncontrolled manner.

By monitoring, in accordance with the invention, the presence of combustible matter in the flue gas stream from the combustion installation and by using the control signal generated by the monitoring device to adjust the combustion stoichiometry in the combustion installation, the efficiency of the combustion installation may be improved.

Combustion installations for which the present invention is of particular interest include non-ferrous metal (re)melting furnaces (such as aluminium, copper, lead and tin melting furnaces and furnaces for melting alloys thereof), iron and iron-alloy melting or remelting furnaces, furnaces for recovering metal from electronic waste (e-waste), cement or lime kilns, waste incineration kilns or shaft furnaces, electric arc furnaces, boilers, etc. According to preferred embodiments, the method according to the invention is used to monitor combustible matter in a combustion flue gas stream from a non-ferrous metal melting furnace, from an iron or iron alloy melting or remelting furnace or from a furnace for recovering metal from e-waste.

When the method is used to monitor combustible matter in a gaseous stream which is a combustion flue gas stream from a combustion installation, the control signal generated by the monitoring device can be communicated to the upstream combustion installation, where the control signal may advantageously be used to adjust the combustion stoichiometry in the combustion installation. Such an embodiment of the invention may in particular be used to reduce or avoid the presence of combustible matter (unburnt matter or products of partial combustion such as CO) leaving the combustion installation as part of the flue gas stream, thereby improving the energy efficiency of the combustion installation. The present method makes it possible to achieve this goal in a fast, accurate and reliable manner:

Speed: The monitoring device instantaneously detects one or more properties of a flame generated in situ in the flowing flue gas stream. No sampling of flue gas is required. Consequently, a very low lag time can be achieved.

Accuracy: The monitoring is performed on the flue gas stream downstream of the installation, in particular the combustion installation, which generates the gas stream. The flame in the gaseous stream which is observed by the monitoring device is thus shielded from the process in the installation and in particular from the flame or flames in the combustion installation (including any radiation from the latter). A higher accuracy is thus achieved. A controlled jet of an oxidant having a higher oxygen content than air is used to generate a flame in the gaseous stream. A higher accuracy is obtained compared to when a flame is generated with ambient air, in particular an uncontrolled quantity of ambient air.

Reliability: Hot flue gas streams, in particular hot combustion flue gas streams, can be corrosive and/or dusty and can contain high levels of condensable matter. When a flame is generated in the gaseous stream, said flame may further generate soot. In that, according to the invention, the window of the monitoring device is spaced apart from the gaseous stream and the window and the line of sight are protected against corrosion, erosion or deposits from the gaseous stream and the flame therein by the controlled jet of oxidant flowing through the lance, a higher reliability and durability is achieved.

When the monitoring device detects the presence of combustible matter in the combustion flue gas stream downstream of the combustion installation or detects the presence of combustible matter in the combustion flue gas stream at a level above a predetermined level, the control signal generated by the monitoring device can be used to change/adjust/regulate the combustion stoichiometry in the combustion installation so as to ensure that the oxygen supply to the combustion installation is sufficient to ensure substantially complete or complete combustion of any combustible substances inside the combustion installation. This may be achieved by increasing the rate at which combustion oxidant is supplied to the combustion installation, without changing the rate at which combustibles are supplied to the installation; by decreasing the rate at which combustibles, in particular fuel, are supplied to the combustion installation without changing the rate at which combustion oxidant is supplied to the combustion installation; or by increasing the ratio of combustion oxidant to combustibles (in particular fuel) supplied to the combustion installation). When the combustion installation is purposefully operated with incomplete combustion and the monitoring device detects a higher than expected level of combustible matter in the combustion flue gas stream, i.e. detects combustible matter at a level above a predetermined level, the control signal generated by the monitoring device can, in the same manner, be used to change/adjust/regulate the combustion stoichiometry in the combustion installation so as to ensure a sufficient, albeit purposefully incomplete, level of combustion of combustible substances inside the combustion installation, thus, for example, optimising combustion energy production in the combustion installation, while ensuring the presence of a non-oxidizing atmosphere in said installation.

According to a preferred embodiment, the control signal generated by the monitoring device is used to adjust the combustion stoichiometry in the combustion installation, by adjusting a fuel flow rate and/or a combustion oxidant flow rate to the combustion installation, within 10 sec, preferably within 4 sec and more preferably within 3 sec from the detection by the monitoring device of the one or more detected flame properties on the basis of which the corresponding control signal was generated.

The oxidant used as combustion oxidant in the combustion installation generating the combustion gas stream may have the same chemical composition as the oxidant of which a controlled jet is injected into the gas stream in accordance with the invention or a different chemical composition.

When the oxidant used as combustion oxidant has a higher oxygen content than ambient air, the energy efficiency of the combustion installation is typically improved with respect to air-combustion operation of the combustion installation. Thus, according to a preferred embodiment, an oxidant having an oxygen content of 22 to 100% vol is supplied from an oxidant source to the combustion installation as combustion oxidant.

Oxidant from two different oxidant sources may be used respectively as combustion oxidant in the combustion installation and for the controlled jet of oxidant which is injected by means of the lance into the gaseous stream. When an oxidant having an oxygen content of 22 to 100% vol is used as combustion oxidant in the combustion installation, oxidant from a same oxidant source may advantageously be used, on the one hand, as combustion oxidant in the combustion installation and, on the other hand, as controlled jet of oxidant which is injected by means of the lance into the gaseous stream as the controlled jet of oxidant.

The present invention also relates to a device for monitoring combustible matter in a gaseous stream adapted for use in the method according to the invention.

The device according to the invention comprises a lance, a sensor and a processing unit. The lance has a first end near a window of the monitoring device and an open second end pointing away from said window. The lance defines a line of sight between the window and the open second end of the lance. The lance further presents an oxidant inlet at or on the side of the first end of the lance. The sensor is located behind the window and is capable of detecting, through the lance and the window, one or more properties of a flame located in front of the second end of the lance. The processing unit is programmed to process the one or more detected flame properties and to generate a control signal on the basis of the one or more detected flame properties. In use, the oxidant inlet of the lance is fluidly connected to a source of oxidant via a flow controller capable of regulating the oxidant flow rate to the lance. The device usefully also comprises a transmitter for transmitting the generated control signal.

According to a preferred embodiment, the sensor is capable of detecting visible or invisible, such as infrared, radiation intensity, preferably a combination of visible and infrared radiation intensity.

The monitoring device may be programmed to detect and/or process the one or more flame properties intermittently or continuously.

The monitoring device preferably also comprises a thermocouple positioned to detect a temperature at or adjacent to the second end of the lance. In that case, the processing unit of the device is in data communication with said thermocouple so as to receive the temperatures detected by the thermocouple. According to one embodiment, the thermocouple is positioned within the lance. According to an alternative embodiment, the thermocouple is positioned within a tube adjacent the lance.

According to a basic embodiment of the method and device of the invention, the control signal generated by the monitoring device on the basis of the one or more detected flame properties which are correlated with the concentration of combustible matter in the gaseous stream, is a binary signal, one of the two binary values corresponding to a level of combustible matter in the gas stream above a predetermined threshold and the second of the two binary values corresponding to a level of combustible matter in the gas stream at or below said threshold. For example, in particular when complete or substantially complete combustion is sought in a combustion installation generating the hot gas stream, one of the two binary signals may be generated when the monitoring device does not detect combustible matter in the gas stream and the other of the two binary signals when the monitoring device does detect combustible matter in the gas stream.

According to a preferred, more advanced embodiment of the invention, the control signal is non-binary. In such a case, the non-binary control signal is advantageously such that the value of the concentration of combustible matter in the gaseous stream may be derived from the value of the control signal. For example, the control signal and the concentration may present a linear dependency on one another.

BRIEF DESCRIPTION OF THE DRAWINGS

The present invention and its advantages are described in more detail in the following non-limiting examples, reference being made to FIGS. 1 to 4, whereby:

FIG. 1 is a schematic representation of an installation comprising a combustion furnace and a monitoring device for use in accordance with the present invention, FIG. 2 is a schematic representation of monitoring equipment suitable for use in accordance with the invention, FIG. 3 is a schematic representation of monitoring equipment suitable for use in accordance with the invention, and FIG. 4 is a schematic representation of monitoring equipment suitable for use in accordance with the invention.

DETAILED DESCRIPTION OF PREFERRED EMBODIMENTS

The melting process illustrated in FIG. 1 is carried out in a so-called Short Rotary Drum Furnace (SRF) 1.

A metallic load 2 to which additives, such as for example coke, iron, fluor, etc., have been added, is charged into the furnace 1.

A naked flame 7 is produced inside the furnace 1 to heat the load 2 directly and to cause the melting-down of the metal or metals contained in the load 2. The obtained liquid metal phase is tapped and directed to subsequent metallurgical processing steps (not shown).

The SRF 1 is charged with metallic load 2 via front doors in the longitudinal axis of the furnace drum. Exhaust fumes leave the furnace through a rear opening of the furnace drum on the same axis. Fumes drawn from the SRF 1 are collected in a vertical off-gas channel 3 directly connected to the rear opening prior to being redirected to a cyclone (not shown) and a further fume filtration device (not shown). SRF 1 is fitted with one water-cooled oxy-gas burner 4 of 3MW nominal power. Natural gas 5 and oxygen 6 are injected from the burner tip to create flame 7 inside the furnace 1.

The illustrated process may, for example, be used for tin melting. In other words, the load which is charged into furnace 1 is a tin load.

Nominal natural gas flow varies between 250 and 300 $Nm^3/h$. Nominal oxygen gas flow varies between 450 and 700 $Nm^3/h$. Nominal off-gases flow is estimated to vary between 2300 and 2700 $Nm^3/h$ and the off-gases nominal temperature between 1100 and 1500° C. CO content in the off-gas varies dynamically during the melting process between 0 up to 30% by volume.

To detect and quantify the CO content in the off-gases, a monitoring device 9 is installed at the one end of a lance 8, which is mounted on off-gas channel 4 outside the furnace drum. The second extremity of lance 8 is open and located inside the stream of off-gas in such a way that the monitoring device 9 can 'observe' the off-gases stream through lance 8. A controlled flow of substantially pure oxygen (at least 99% by volume oxygen) at between 1 to 30 $Nm^3/h$ at ambient temperature is injected through lance 8 towards and into the off-gas stream. Thereto lance 8 is connected to an oxygen source, in this case oxygen reservoir 12, though the oxygen source could also be an oxygen pipeline or an Air Separation Unit.

The oxygen thus injected into the off-gas stream causes the CO contained in the off-gas to burn and creates a further flame 10 proportional in dimension, temperature and radiation to the quantity of CO contained in the off-gases.

So as to avoid any misunderstanding, the term "flame" as used herein includes both visible flames and diluted flames, also referred to as flameless combustion.

The monitoring device 9, while observing the flame 10 through the lance 8 captures at least one of these flame properties (dimension, temperature and radiation) and generates a control signal proportional to the quantity of CO contained in the off-gas. The generated control signal is transmitted to a digital data processing unit 11, such as a programmable logic controller (PLC), for data processing. The processed data are used as a control signal to adjust the ratio of oxygen and natural gas injected through burner 4 in accordance with the method described in WO2010/022964. In this manner, the time-lapse between the detection of the one or more flame properties of flame 10 and the adjustment step in furnace 1 is kept very short (below 10 seconds, preferably below 4 seconds or even below 3 seconds).

By thus optimising the operation of furnace 1 and keeping the presence of combustible matter, such as CO, in the off-gas stream to a minimum, savings in specific natural gas consumption up to 20% can be achieved.

FIG. 2 shows a monitoring unit suitable for use in the present invention.

The monitoring unit comprises a monitoring device 9 with a window 91 through which one or more properties of a flame located in front of window 91 may be detected by monitoring device 9.

An injection lance 8 extends forward from window 91. At the end of lance 8 towards monitoring device 9 (the upstream end of lance 8), lance 8 is provided with an oxygen inlet 81 via which oxygen can be fed to lance 8 at a controlled rate. The opposite extremity 82 of lance 8 (downstream end) is an open end. Lance 8 is straight, with no internal obstructions, so that lance 8 defines a clear line of sight between window 91 of monitoring device 9 and the open end 82 of lance 8. Lance 8 is further provided with a flange 83 with which the monitoring unit can be mounted on a gas-flow duct, such as an off-gas channel of a combustion installation.

When flange 83 is mounted on a gas-flow duct through which a hot gas stream flows and a controlled flow of oxygen is supplied to lance 8 via oxygen inlet 81, said oxygen is injected into the hot gas stream as a controlled oxygen jet. When the hot gas stream contains combustible matter, a flame is generated where the combustible matter meets the oxygen of the controlled jet. Via the line of sight through lance 8 and window 91, monitoring device 9 detects one or more properties of said flame. For example, the monitoring device 9 may be constructed and programmed to detect the radiation intensity of said flame at the wavelength corresponding to CO combustion. The detected intensity is therefore an indication of the concentration of CO in the gas stream. Thereafter, monitoring device 9 generates a control signal based on the detected radiation intensity.

Alternatively, or in combination with said radiation intensity, monitoring device 9 may detect, by way of flame property, IR (infrared) radiation from the flame and use the detected IR radiation to generate the control signal.

The monitoring unit of FIG. 3 differs from the monitoring unit of FIG. 2 in that it comprises, in addition to lance 8, a further oxygen tube 100 in which a thermocouple 101 is mounted. The thermocouple 101 is in data communication with monitoring device 9. The controlled flow of oxygen which is fed through oxygen inlet 81 is divided between lance 8 and tube 100 so that each injects a separate controlled jet of oxygen into the hot gas stream and when combustible matter is present in said gas stream, a flame is generated in the gas stream where the combustible matter comes into contact with the injected oxygen. Via the line of sight in lance 8 and window 91, monitoring device 9 detects one or more flame properties as described above. In addition, via thermocouple 101 in tube 100, monitoring device 9 further detects a flame temperature which may be used as a further input for monitoring device 9 to generate the control signal, as a possible backup input for generating the control signal or as a safety check to verify the prima facie correctness of the flame property or properties detected via the line of sight and window 91.

The monitoring unit of FIG. 4 differs from that shown in FIG. 3 in that tube 100 is not fluidly connected to oxygen inlet 81 of lance 8. In that case, tube 100, in which the thermocouple is positioned, may be separately supplied with a controlled jet of oxidant gas, which is subsequently injected into the gas stream. Alternatively, a relatively small amount of sweeping gas may be made to flow through tube 100 in which the thermocouple is positioned or no gas at all.

According to a non-illustrated embodiment, a thermocouple may be positioned within lance 8.

The method according to the present invention was used to monitor combustible matter in a stream of flue gas evacuated from a lab-scale furnace.

The flue gas temperature was greater than 1000° C. The carbon monoxide content in the flue gas varied from 0 to 12% vol.

The oxidant used was pure oxygen.

The monitoring unit was mounted onto the flue-gas duct of said furnace. The monitoring device was equipped with a photosensor located behind the window of the monitoring device of the unit. The photosensor was capable of measuring radiation intensity in the visible and IR range. Thus, when a flame was generated at the downstream end of the oxygen lance defining a line of sight between the window and said downstream end, monitoring device detected the intensity of the flame radiation in the visible and IR range via said line of sight and window.

In a first set of tests, the oxygen was injected at different flow rates into a gas stream in the temperature range of the furnace flue gas and at varying known concentrations of CO in the gas stream. In this manner, the oxygen flow rate through the lance, and thus also the oxygen injection velocity, providing the most pronounced temperature rise due to combustion of combustible matter with the oxygen in the gas stream was determined. Under the specific test conditions, an oxygen flow rate value of 0.25 $Nm^3/h$ was found to be optimal for every CO level. In other words, said oxygen flow rate provided the greatest flue-gas temperature increase detected by the thermocouple for every level of CO. The size of said maximal temperature increase itself increased with increasing CO level in the gas stream. In addition, it was found that said oxygen flow rate also provided the highest detected flame radiation intensities detected by the photosensor for every CO level, whereby the level of the detected radiation intensities also increased with increasing CO levels in the gas stream.

The first set of tests was used to calibrate the monitoring unit.

In a second set of tests, the calibrated monitoring device was used to monitor the CO in the hot flue-gas stream from the furnace operating at various power levels and combustion stoichiometries. When the photosensor detected radiation intensities corresponding to a CO level in the flue gas stream exceeding a predetermined acceptable upper limit, the monitoring device generated a control signal for the corresponding adjustment of the oxygen-to-fuel ratio of said burner.

The second set of tests proved it was possible, following calibration with test results, to use the monitoring device to reliably determine the CO content in an unknown flue gas stream with a monitoring device spaced apart from the flue gas stream and without interference from the flame in the furnace.

Comparison between the CO levels determined on the basis of flame radiation by the monitoring device with the CO levels determined on the basis of the temperature rise detected by the thermocouple confirmed the accuracy and reliability of the monitoring device of the invention.

The effectiveness of the method and device according to the present invention for monitoring combustible matter in a hot gaseous stream was confirmed during long-term testing on an industrial furnace for melting non-ferrous metal and in which a reducing atmosphere was maintained. The detected flame properties were pixelated multispectral radiation intensities in the visual and near infrared range. The control signal was generated on the basis of the principles described in WO-A-2010/022964. The method and device were found to be robust and reliable and considerable energy savings were achieved without increased oxidation of the charge.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A method for monitoring combustible matter in a gaseous stream by means of a monitoring device, whereby the gaseous stream flows at a temperature of at least 550° C. along a flow path extending from a gas inlet to a gas outlet, the method comprising;

extending a lance between a window of the monitoring device and the flow path, said lance defining a line of sight between the window and the gaseous stream in the flow path, injecting a controlled jet of an oxidant having an oxygen content of 22 to 100% vol into the gaseous stream by means of the lance so that, in the presence of combustible matter in the gaseous stream, said combustible matter burns with the oxidant in a flame in the gaseous stream in front of the lance, detecting one or more properties of the flame which are correlated with the concentration of combustible matter in the gaseous stream by the monitoring device through the line of sight and the window, and processing the one or more detected flame properties in the monitoring device and generating a control signal on the basis of said one or more detected flame properties, wherein the lance extends into the flow path from 0% to 50% of the cross-section diameter of the flow path.

2. The method according to claim 1, whereby the controlled jet of oxidant is injected in the lance at a flow between 0.1 $Nm^3/h$ and 50.0 $Nm^3/h$.

3. The method according to claim 1, whereby the control signal is communicated to an upstream installation generating the gaseous stream and used as a control parameter therein and/or is communicated to a downstream gas treatment installation and used as a control parameter for the control of said installation.

4. The method according to claim 1, whereby the monitoring device detects visible and/or non-visible radiation intensity of the flame.

5. The method according to claim 1, whereby the gaseous stream is a combustion flue gas stream from a combustion installation.

6. The method according to claim 5, whereby the combustion installation is selected from the group consisting of non-ferrous metal melting furnaces, iron and iron-alloy melting or remelting furnaces, furnaces for recovering metal from electronic waste, cement or lime kilns, waste incineration kilns or shaft furnaces, electric arc furnaces and boilers, non-ferrous metal melting furnaces, iron or iron alloy melting or remelting furnaces and furnaces for recovering metal from e-waste.

7. The method according to claim 5, whereby the control signal is communicated to the upstream combustion installation and used to adjust the combustion stoichiometry in the combustion installation.

8. The method according to claim 5, whereby an oxidant having an oxygen content of 22 to 100% vol is supplied from an oxidant source to the combustion installation as combustion oxidant, and whereby oxidant from the same oxidant source is injected by means of the lance into the gaseous stream as the controlled jet of oxidant.

* * * * *